United States Patent [19]

Piela

[11] 3,997,000

[45] Dec. 14, 1976

[54] MECHANICAL CLEANING DEVICE FOR BOILERS WITH GAS FLOW CONTAINING STICKY DUST

[75] Inventor: Adam Piela, Pierrefonds, Canada

[73] Assignee: Dominion Bridge Company, Limited, Montreal, Canada

[22] Filed: Nov. 14, 1975

[21] Appl. No.: 632,020

[30] Foreign Application Priority Data

Sept. 25, 1975 Canada ..... 236320

[52] U.S. Cl. ..... 165/84; 122/379

[51] Int. Cl.[2] ..... F28D 11/06; F28G 7/00

[58] Field of Search ..... 165/5, 84, 95; 122/379, 122/510; 15/104.04

[56] References Cited

UNITED STATES PATENTS

| | | | |
|---|---|---|---|
| 1,953,500 | 4/1934 | Price | 165/84 |
| 3,721,217 | 3/1973 | Willach et al. | 165/84 |
| 3,835,817 | 9/1974 | Tuomaala | 165/84 |

*Primary Examiner*—Charles J. Myhre
*Assistant Examiner*—Theophil W. Streule, Jr.
*Attorney, Agent, or Firm*—Larson, Taylor and Hinds

[57] ABSTRACT

This invention relates to a novel tubular heat exchanger of the type subjected to hot gases and employs rappers to dislodge particulate material adhering to tubes of the exchanger. At least two parallel rows of serpentine tubes are positioned within a hot gas duct and are so arranged that the upper and lower loops define in a direction transverse to the rows of tube, parallel upper and lower loops. The rows are flexibly suspended at their upper ends. First knocker plates are positioned on opposed transverse faces of the upper loops and in a like manner, second knocker plates are positioned on the bottom loops. At least one rapping rod is positioned intermediate the upper and lower loops and extends between the tubes in the transverse direction. Raping of the tubes causes adjacent tubes to rap one another at their upper and lower loops. Relatively uniform rapping along the full vertical component of the tubes is achieved.

8 Claims, 3 Drawing Figures

MECHANICAL CLEANING DEVICE FOR BOILERS WITH GAS FLOW CONTAINING STICKY DUST

This invention relates to tubular heat exchangers used in the generation of hot liquid or steam, and more particularly, to tubular heat exchangers which are subjected to hot gases carrying with the particulate material.

Many hot gases used to generate steam or the like carry with them solids which tend to adhere and build up on the exterior surfaces of the heat exchanger tubes. Such build-up, if permitted to continue unchecked, results in a reduction of thermal efficiency and may also impede the passage of hot flow gases therethrough.

Mechanical rapping devices are conventionally employed to effectively hammer or "rap" the serpentine rows of heat exchanger tubes in order to knock-off accumulated solids or dust. Indeed, in particularly dirty gases, it is not uncommon to rap the tubes every hour or half hour in order to dislodge adhering contaminates.

One typical rapping arrangement is disclosed in U.S. Pat. No. 3,316,886, Edouard Rudekiel, issued May 2, 1967 entitled BACK-HEAT BOILER. In this prior art arrangement, the patentee introduces a poker or lance into the vertical rows of tubes. The poker is provided with a bulbous end which passes back and forth between the vertical rows. This creates vibrations in the tubes whereupon material adhering to the tube is dislodged. Because proper vertical alignment of the tubes is important for passage of the poker, the patent also makes provision for restraining means which limit the transverse displacement of the tubes so that the poker is in effective alignment therewith.

In another prior art system, as disclosed in U.S. Pat. No. 2,183,496, H. Peters, issued Dec. 12, 1939, entitled CLEANING TUBULAR HEAT EXCHANGING SURFACES, a reciprocating striking plate is used to impart impact vibrations to the tubes. Unlike the poker system above, the reciprocating striking plate may be positioned within the tube so that all of the tubes may be rapped simultaneously and alignment considerations of the tubes are not critical.

In some heat exchanger applications, vertical tube lengths in the order of 20 feet or more are required. Heat exchangers with long tube lengths have an economic advantage over those with short tube lengths because they possess fewer bends for the same overall lengths of tube. The prior art rapping arrangements above discussed are not considered satisfactory in installations having vertical tube lengths of 20 feet or more, as the tubes are prone to bending and misalignment through the influence of hot gases even apart from distortion which can occur through rapping. More importantly, however, is the fact that these prior art arrangements are not considered satisfactory in effecting dislodgement of particulate material over the full vertical length component of the tubes. Those portions of the tube extremities remote from the poker or reciprocating striker plate tend to permit the build-up of dust contaminates. Further, if the tubes are subjected to excessive rapping impact in order to dislodge build-up from the areas remote from the rapping rod or poker, cracking or joint failure may occur in the tubes necessitating considerable down time for repairs.

In accordance with this invention, it has been found that rapping of the tubes and resultant dislodgement of the contaminating material adhereing thereto is significantly improved where the serpentine rows of tubes are effectively rapped in the proximity of their top and bottom loops as well as on the vertical portion of the tubes intermediate these loops. As a consequence, additional rappers are not required where the vertical component of the length of tubes may be in the order of twenty feet or more and since the rows of heat exchange tubes are designed for limited flexibility, the likelihood of tube failure during rapping is reduced.

The novel heat exchanger of this invention comprises a duct for the passage of hot gases therethrough and has therein at least two vertically aligned and parallel rows of serpentine tubes. Each row of tubes has at least one upper loop and at least one lower loop which are arranged in line and parallel to a line transverse to the parallel rows of tubes. As the upper loop in each row is to be rapped, means are provided for flexibly suspending or hanging the rows of tubes. First knocker plates are positioned on the opposed transverse face of each lower loop in each row in order to effect rapping at that point and, in a like manner, second knocker plates are positioned on both transverse faces of the upper loop in each row. Knocking or rapping of the tubes at their loop ends is induced by at least one rapping rod positioned intermediate the upper loop and the lower loop in each row and extending between the tubes in a direction transverse to the rows. The rapping rod includes at least one horizontally opposed rapping lug which is positioned on the rapping rod at points adjacent at least one row of tubes, and rapping means are provided to deliver a reciprocating motion to the rapping rod.

During operation, the rapper lugs bang or "rap" the vertical tube components of each pair of tubes through which the rod extends, with the vibrations set up being transmitted to the upper and lower loops. As the upper loop ends are flexibly suspended and the lower loop ends are freely hanging, rapping at this point is imparted to the neighbouring row of tubes in the pair through the first and second knocker plates.

In order to quickly remove the tube bundle from the heat exchanger shell in order to facilitate repair, in accordance with a further embodiment of this invention, the rapper rod may be pivoted 90° about its axis so that the rod lugs do not interfere with the tube bundle removal. Additionally, rapping means for reciprocating the rod such as a double acting air cylinder can be mounted exteriorly of the duct on its own supporting base having a separate foundation to that supporting the heat exchanger in order to minimize unwanted vibration in the supporting steel and duct structure surrounding and supporting the tubular heat exchanger.

In drawings which illustrate one working embodiment of this invention employing two rapper rods:

Figure 1:
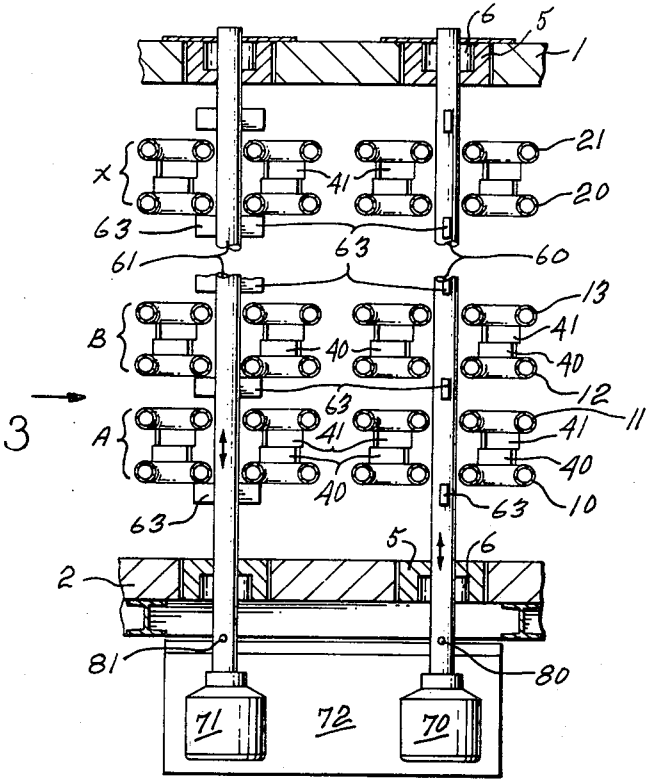
FIG. 1 is a top section, partially cut away illustrating parallel rows of serpentine tubes and two rapping rods.
Figure 3:
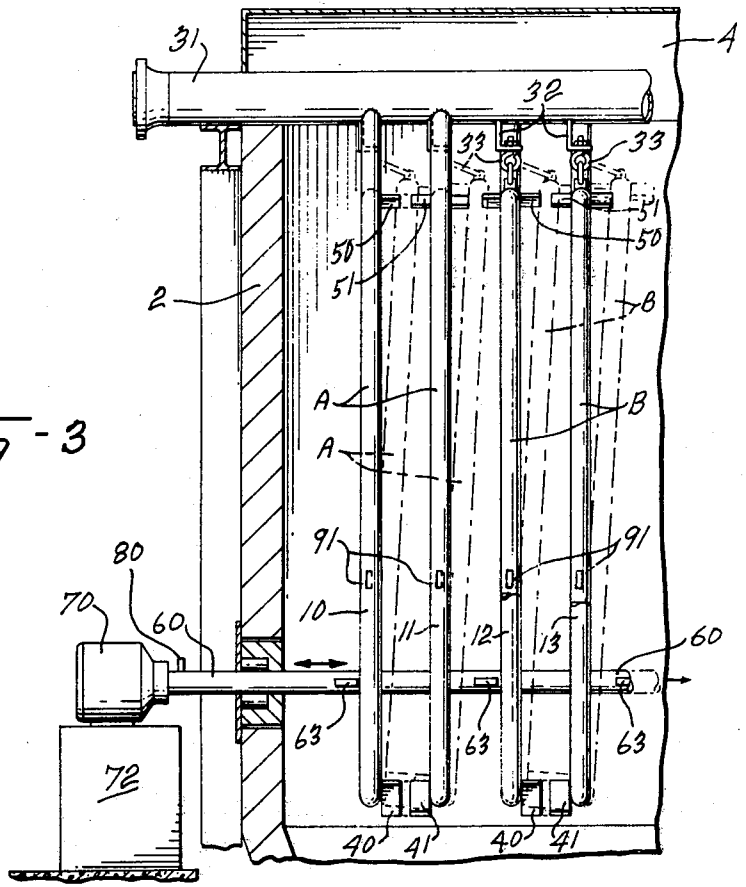
FIG. 3 is a partial end view of the heat exchanger illustrating two pairs of serpentine rows of tubes with the air cylinder mounted exteriorly of the duct.

Referring to the drawings and as best seen in FIG. 1, the tubular heat exchanger comprises side walls 1 and 2 with parallel rows of serpentine tubes 10, 11, 12, 13, 20 and 21 positioned therein. Hot gas passes between the side walls over the outside surface of the tubes in the direction of arrow 3. The parallel rows of tubes are grouped in pairs, pairs A, B and X being illustrated. As best seen in FIG. 3, the opposed upper and lower loops of serpentine tubes are provided with upper and lower knockers 40, 41 and 50, 51 respectively. The two ends of each of the rows of tubes 10, 11, 12, 13, 20 and 21 are connected to headers 30 and 31 in a conventional manner in order to permit the passage of a fluid medium therethrough such as water, steam or the like.

The upper loops of each row of tubes are flexibly suspended by structural member 32 forming part of the headers 30 and 31 by means of link chains 33. Extending transversely through the vertical components of the parallel rows of tubes are reciprocal rapping rods 60 and 61. These rods are supported in position through bearing blocks 5 and bearings 6 provided in or outside of duct walls 1 and 2. The rapping rods include laterally opposed rapping lugs 63 which are positioned between each pair of tube rows A, B and X. Additional rapping lugs can also be positioned adjacent rows 10 and 21 and walls 1 and 2. Furthermore, although the rapping rods illustrated are located closer to the lower loops, they can, if desired, be positioned at any location intermediate the loops although the lower location is preferred in practice.

Figure 2:
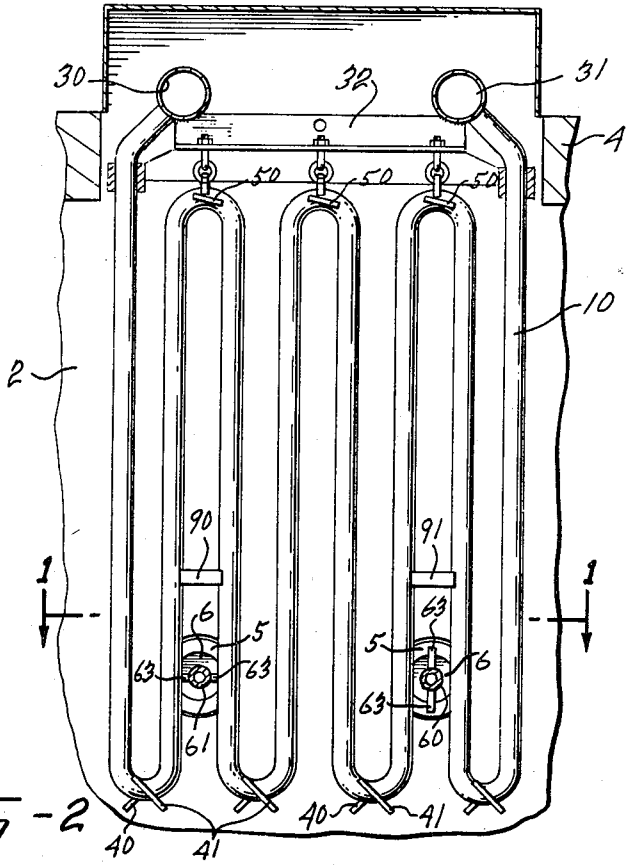
FIG. 2 is a side view of one serpentine tube of the tubular heat exchanger illustrating one rapping rod in its operating position and the other in the tube bundle withdrawal position.

As best illustrated in FIGS. 1 and 2, the ends of rapping rods 60 and 61 extending through duct wall 2 are connected to double acting air cylinders 70 and 71 which are mounted on base 72 which is exterior of the heat exchanger in order to minimize unwanted vibration in the duct, and other parts of the heat exchanger. In one embodiment, the base 72 is a concrete block having a separate foundation to that supporting the heat exchanger. Furthermore, cooling of the rapping rods 60 and 61 may be achieved by passing air, water or the like through the hollow rods at air entry points 80 and 81 adjacent cylinders 70 and 71 for discharge at the other end.

The rapping of all of the tube rows 10, 11, 12, 13, 20 and 21 is accomplished through the rapping rods 60 and 61 and their associated rapping lugs 63. Cycling of the rapping rods can be adjusted up to 300 strokes per minute if desired with the stroke being varied for example, anywhere from ¼ inch to 1 inch. At the upper and lower loops in each adjacent row, rapping at that point occurs due to the knockers 50 and 51. The degree of vibratory rapping at the upper and lower loops can be controlled by the spacing between knockers 40, 41 and 50, 51 which is typically in the order of a ⅜ inch to ⅝ inch gap.

With reference to FIGS. 1 and 2, rapping rod 60 as illustrated therein has been rotated 90° so that the lateral lugs 63 now lie in a vertical plane parallel to the vertical component of the tubes.

The tube bundle including headers may then be removed by disconnection from the piping and by being raised vertically. In a preferred embodiment the tubes are at least twenty feet in vertical length, and in order to reinforce adjacent vertical tube portions in a tube row, cross bracers 90 and 91 are inserted between the tube portions through which the rapping rods 60 and 61 pass. These bracers are positioned above the rapping rods and prevent the tube portions from separating whilst being reciprocated. The rapping rods 60 and 61 are preferably located below the mid-position of the vertical length of the tubes.

In one example of a heat exchanger of the present invention, the vertical distance between the upper loops and the lower loops was 25 feet and the rappers were placed 6¼ feet from the lower loops. The outside diameter of the tubes was 1½ inches.

In another example of a heat exchanger with a 1¾ inch outside diameter tube, a 30-foot vertical distance between upper and lower loops was used.

The embodiments of the invention in which an exclusive property or privilege is claimed are defined as follows:

1. A tubular heat exchanger comprising a duct for the passage of hot gases therethrough, at least two vertically aligned parallel rows of serpentine tubes wherein each row has at least one upper loop and at least one lower loop and wherein said upper loop and said lower loop in each row are in line and parallel to a line transverse to the rows of tubes, means for flexibly suspending the tubes within said duct, first knocker plates on the opposed transverse face of each lower loop in each of said tubes, second knocker plates on both transverse faces of the upper loop in each of said tubes, at least one rapping rod positioned intermediate the upper loop and the lower loop in each row and extending between the tubes in a direction transverse to the rows, said rapping rod including at least one horizontally opposed rapping lug located adjacent at least one row of tubes, and rapping means adapted to deliver a reciprocating motion to the rapping rod.

2. The tubular heat exchanger as claimed in claim 1 wherein the means for flexibly suspending the tubes comprises link-chain hangers.

3. The tubular heat exchanger as claimed in claim 1 wherein the rapping means is a double acting air cylinder mounted exteriorly of said duct.

4. The tubular heat exchanger as claimed in claim 1 wherein the rapping means is a double acting air cylinder mounted exteriorly of said duct on a separate foundation to that supporting the heat exchanger.

5. The tubular heat exchanger as claimed in claim 1 wherein said rapping rod is pivotable about its axis to permit withdrawal of said tube bundle from within said duct.

6. The tubular heat exchanger as claimed in claim 1 wherein the vertical distance between the upper loops and the lower loops is at least 20 feet.

7. The tubular heat exchanger as claimed in claim 1 wherein the rapping rod is positioned below the midposition of the vertical distance between the upper loops and the lower loops.

8. A tubular heat exchanger comprising a duct with opposing side walls defining a passage for hot gases, a plurality of vertically aligned serpentine tubes, each of said tubes having a plurality of upper loops and a plurality of lower loops in a row parallel with the other tubes and the side walls, means for flexibly suspending each of the said tubes at the upper loops, first knocker plates attached to the opposed transverse face of each lower loop, each of the lower loops having at least one of said first knocker plates on one transverse face thereof, second knocker plates attached to both transverse faces of the upper loops, at least one rapping rod positioned between the upper loops and the lower loops extending transversely across the duct between the opposing side walls, said rapping rod having a plurality of horizontally opposed rapping lugs positioned between every second row of tubes, and rapping means adapted to deliver a reciprocating motion to the rapping rod.

* * * * *